US006103327A

United States Patent [19]

Bragole et al.

[11] Patent Number: 6,103,327

[45] Date of Patent: Aug. 15, 2000

[54] ANTI-GRAFFITI/PROTECTIVE COVER STOCKS FOR VINYL FACE STOCKS

[75] Inventors: Robert A. Bragole, Danvers; Peter Kashian, Wayland, both of Mass.

[73] Assignee: Worthen Industries, Inc., Nashua, N.H.

[21] Appl. No.: 09/114,442

[22] Filed: Jul. 13, 1998

[51] Int. Cl.[7] ..... G09F 7/16

[52] U.S. Cl. ..... 428/40.1; 428/40.6; 428/40.7; 428/41.3; 428/41.7; 428/352; 428/421; 428/424.2; 428/424.6

[58] Field of Search ..... 428/40.1, 40.6, 428/40.7, 41.3, 41.7, 352, 421, 424.2, 424.6

[56] References Cited

U.S. PATENT DOCUMENTS 5,498,307 3/1996 Stevenson ..... 156/277

5,606,005 2/1997 Oshita ..... 528/83

FOREIGN PATENT DOCUMENTS 2627615 8/1989 France .

62-181375 8/1987 Japan .

*Primary Examiner*—Nasser Ahmad

*Attorney, Agent, or Firm*—Samuels, Gauthier & Stevens

[57] ABSTRACT

An anti-graffiti cover stock for vinyl face stocks which comprises a film selected from the group consisting of polyolefins and polyvinyl fluoride and a polyester based polyurethane adhesive coated on one surface of the film to form a cover stock. The cover stock is characterized in that when it is adhered to a vinyl substrate to form a laminate, the laminate meets the flex characteristics of ASTM D 2907-95.

7 Claims, 1 Drawing Sheet

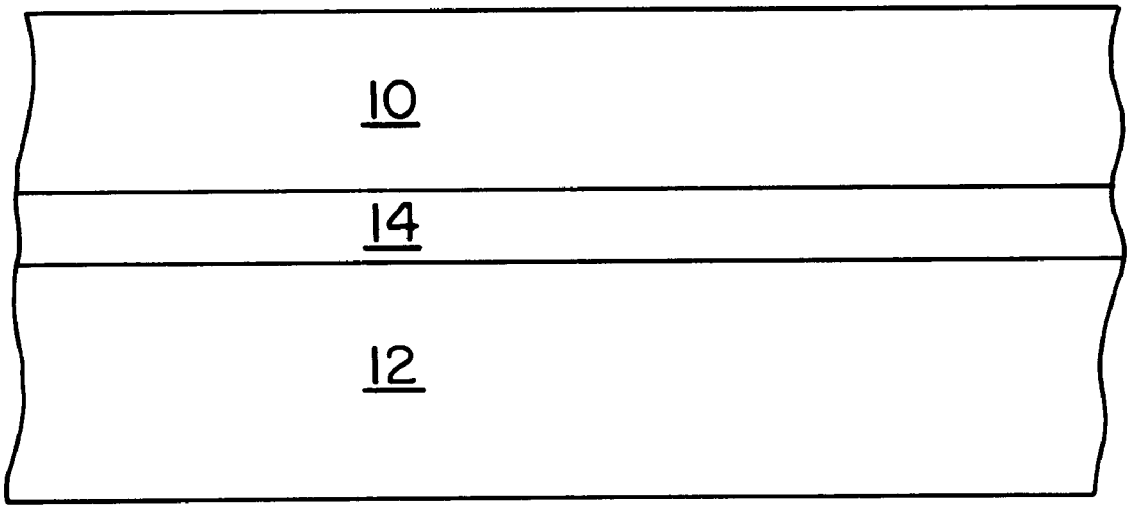
10
14
12

ANTI-GRAFFITI/PROTECTIVE COVER STOCKS FOR VINYL FACE STOCKS

BACKGROUND OF THE INVENTION

1. Field of the Invention

A cover stock to protect plastic trim surfaces such as vinyl, against destruction, marring, tearing, discoloration and non-removable graffiti.

2. Description of Relevant Art

Vinyl is a widely used component for face stock in automotive components. Vinyls are used extensively in automobile interiors for face stocks on substrates to form instrument panels, door panels, center consoles, pillars, package trays, headliners and perhaps some seating. Vinyl is also used extensively for seating in mass transit systems. Vinyls are used because they provide the desired physical properties for the intended end use at low cost. Other possible cover stock(s) for auto interiors are thermoplastic olefins.

One drawback to the use of vinyls is that they can be easily marked or defaced. Accordingly, in many end uses of vinyl, protective coatings, cover stocks, are applied to the vinyl.

Cover stocks used for protection of vinyl such as TEDLAR® (polyvinyl fluoride) possess an anti-graffiti property but are expensive and difficult to bond. Other protecting cover stocks for vinyl do not possess anti-graffiti qualities but are flexible, have the desired aesthetics such as low gloss, and other attributes such as good heat aging and good weathering properties. However, in addition to lacking anti-graffiti qualities, they also lack mark-off qualities. This latter quality relates to surface destruction of the vinyl due to marring or tearing.

SUMMARY OF THE INVENTION

The present invention embodies a polyurethane based adhesive which will laminate a polyolefinic anti-graffiti cover stock (film), polyolefin or polyvinyl fluoride, to a vinyl face stock (substrate). The adhesive system is especially suitable for automotive interior trim applications requiring vacuum forming. Flexibility (elongation) of the cover stock/adhesive is an important consideration because of the severe stretching of the cover stock during vacuum forming.

Broadly the invention comprises laminating polypropylene (sp. g. 0.90) or high-density polyethylene (sp. g. 0.91–0.96) protective films as cover stocks to vinyl face stock, with the adhesive systems disclosed herein, to provide anti-graffiti coatings to the vinyls. The thickness can range between 0.8 to 1.6 mils thick. These protective films are economical, have anti-graffiti properties and outstanding flexibility. The protective films are considerably more cost effective and have superior flexibility versus prior art films. The adhesive systems provide the desired bonding while more importantly they are not affected by the severe bending and elongation the system undergoes during vacuum forming. As is known to one skilled in the art, in forming an automotive component comprising a base substrate and a face stock, the face stock is drawn onto the base substrate by vacuum to ensure that the cover stock uniformly conforms to the surface of the base substrate. A cover stock must exhibit the same properties.

The process of the invention comprises forming an anti-graffiti cover stock by (a) coating a (protective) polyolefin film or polyvinyl fluoride with a polyurethane adhesive (b) heating a vinyl substrate and drawing the adhesive coated film over the vinyl face stock and (3) nipping together with pressure to bond the protective cover stock to the vinyl face stock. Alternatively, the polyolefin film can initially be treated by corona discharge.

The protective film/adhesive system of the invention has excellent tensile/elongation properties, high temperature resistance and excellent vinyl adhesion.

In an alternative embodiment of the invention the protective film can be extruded onto a primed or adhesive coated vinyl surface rather than laminated.

The following compounds or a combination of these compounds are used in the synthesis of polyurethane adhesive dispersions.

1) an organic isocyanate compound, preferably a polyisocyanate;

2) an organic compound containing at least two active hydrogens and at least one ionized or easily ionizable group;

3) a polyol, preferably of an oligomeric or polymeric polyol which exhibits a degree of crystallinity and a melting point or melting temperature range;

4) an extender for reacting with a prepolymer to further enhance its properties; and 5) a base for neutralizing the ionized or easily ionizable group of the organic compound.

The preferred organic (aromatic, aliphatic or cycloaliphatic) isocyanate compounds (1) are polyisocyanates containing at least two isocyanate groups. Suitable diisocyanates which may be employed in this invention include aromatic, aliphatic or cycloaliphatic diisocyanates, such as 4,4'-diphenylmethane diisocyanate (MDI), 2,4- and 2,6-toluene diisocyanate (TDI), ditolyl diisocyanate (TODI), 1,5-naphthalene diisocyanate, 4,4'-dibenzal diisocyanate, m- or p-xylene diisocyanate, 1,3-phenylene diisocyanate, 1,6-hexamethylene diisocyanate, isophorone diisocyanate, 1,4-cyclohexane diisocyanate and the like.

The compound (2) having at least two active hydrogens and at least one ionized or easily ionizable group preferably includes diamine or diol compounds containing carboxylic groups capable of salt formation. These organic compounds contain at least two amine or hydroxyl groups and at least one comparatively unreactive carboxylic group at a lateral or terminal position, either in the salt form or in a form capable of salt formation by neutralizing with a suitable base or a salt generating agent. Suitable carboxylic containing compounds are preferably an alpha, alpha dimethyl C2–C10 alkanoic acid such as 2,2-dimethylol propionic acid.

The polyol (3) may be any of a wide variety of oligomeric or polymeric polyols, with polyester or caprolactone based polyols containing at least two hydroxyl groups being preferred. These polyols should be crystalline with a crystalline melting point or melting range of 30° C. to 100° C., and preferably 40° to 70° C. The polyol may have slow or fast crystallization rate, but moderate to fast crystalline rates are preferred.

Suitable polyols used include those that are predominantly linear having a molecular weight in the range of 300 to 5,000 and, preferably 1,000 to 2,000. These may include for example, polyesters, polyethers, polyesteramids, polyacetals, polythioesters, polyacetones and the like. Dihydroxy polyesters are those obtained from the reaction of dicarboxylic acids as single species or mixes (such as, succinic acid, adipic acid, suberic acid, azelaic acid, sebacic acid, phthalic acid, isophthalic acid, teraphthalic acid, tetrahydrophthalic acid and the like) with diols (such as ethylene glycol, 1,2- and 1,3-propylene glycol, diethylene glycol, 1,4- and 1,3-butanediol, 1,6-hexanediol, 1,8-octanediol, neopentyl glycol, 1,3-(2-methyl) propyldiol, and the like) as single species or mixers. A particularly preferred compound is a hexane diol-mixed acid polyester diol, e.g. hexane diol adipate/hexane diol.

A chain extender, (4), is used to extend the isocyanate prepolymer. This extender is an organic compound of low molecular weight and contains at lest two active hydrogen atoms. These compounds react with the isocyanate groups and build up the molecular weight of the polyurethane as well as contribute to the physical properties of the polymer.

The phrase "low molecular weight" is intended to refer to the molecular weights of about 62 to about 500, preferably from about 90 to about 200. Preferred extenders include hydrazine and/or adipic dihydrazide.

The bases (5) used in this invention to convert the carboxylic acid containing compounds to their respective salts by neutralizing the carboxylic acid groups, are either organic or inorganic bases. Suitable salt-generating compounds used in this invention are basic tertiary amines containing organic compound, which can neutralize the carboxylic groups. Examples are N-alkyldialkanolamines (e.g., N-methyl diethanolamine), N-N-dialkylalkanolamines (e.g., N-N-diethyl ethanolamine), trialkylamines (e.g., triethylamine) and the like.

Inert organic solvents, preferably those that can easily solubilize the reactants at a suitable high concentration and at the required reaction temperature may optionally be used in the formulations of this invention. The preferred organic solvent is a highly polar, high boiling solvent such as 1-methyl-2-pyrrolidone.

The isocyanate-terminated prepolymer is prepared by reacting the diisocyanate with the oligomeric or polymeric polyol, or a mixture of suitable polyols in a required ratio, and with the dihydroxy compound containing the carboxylic group, preferably, dimethylol propionic acid, in an inert organic solvent, preferably, 1-methyl-2-pyrrolidone. The total amount of the solvent used for the synthesis is in the range of 0 to 25% by weight of the polymer, preferably in the range of about 3 to 15% more preferably in the range of about 5 to 12%. The amount of organic solvent used in the isocyanate-terminated prepolymer synthesis depends on the reactant concentration and the reaction temperature.

The reaction is carried out at a temperature range of about 50 to 140° C., over a time period of one half hour to eight hours, depending on the reaction temperature and the reactivity of the reactants. Preferably, the reaction temperature is in the range 60 to 100° C., and the reaction time period is about 1 to 2 hours.

For the chain extension of the prepolymer, the low molecular weight chain extender can be added to the reaction either at the beginning of the reaction or towards the end of the reaction.

To the prepolymer thus prepared, a low molecular weight base, preferably a tertiary amine compound, is added to neutralize, either partially or fully, the carboxylic acid groups in the backbone of the prepolymer. This base may be added to the reaction mixture in a temperature range of about 20 to 45° C., more preferably, in a temperature range of about 20–38° C. The carboxylate ionic groups formed impart self-emulsifying properties to the prepolymer. The amount of the ionic(salt)-type groups in the polymer chain is in the range of 10 to 100 milli-equivalents per 100 grams of the polymer, more preferably, in the range of 15 to 60 milli-equivalents per 100 grams of the polymer. Water is added to the prepolymer under vigorous stirring conditions to form a dispersion. The water temperature may be anywhere in the range of 5 to 45° C., more preferably, water at room temperature is used (20–34° C.).

The polyurethane dispersion thus obtained may be diluted with water to obtain the required percent solid levels. The viscosity of the emulsion may be adjusted using a suitable thickener, that will give a stable viscosity if necessary, and one that will not interfere with the required dispersion, polymer and/or adhesive properties.

Dispersion and extension reactions can be carried out simultaneously by mixing the base used for the salt formation and the diamine with the water to which the prepolymer solution is added. When the diamine level is below the stoichiometric amount required to react with the free isocyanates, foaming can be observed during the dispersion/extension step as a result of the reaction of the free isocyanate with water This can be overcome by adding a defoamer to the prepolymer solution before dispersion, or during or after the dispersion/extension process.

The aqueous polyurethane dispersions obtained have particle sizes in the range of 10 nm to 10 microns, preferably in the range of 0.05 to 1 micron, and preferably in the range of 0.005 to 1 micron, and more preferably in the range of 0.1 to 0.5 micron. The particle sizes may vary depending on the reaction and the reactor parameters. The molecular weight of the polymers are generally in the range 10,000 to 500,000 depending on the reaction parameters and the extension reaction. If multi-functional extenders are used in the final reaction, the polymer molecular weight may even be higher. The dried polymer films often exhibit melting and/or glass transition temperatures. The melting peaks may generally occur in the range of about 30 to 100° C., and the glass transition temperatures fall in the range of about −50 to −10° C.

The aqueous polyurethane dispersions obtained by the process described in this invention can be up to about 60% solids and the emulsion viscosity can be up to about 10,000 cps or higher. These dispersions can be used directly, without other additives, for adhesive applications. Other chemicals can be added to the polyurethane dispersion to formulate for particular applications, for example, use of thickeners, fillers, pigments, wetting agents, defoamers and the like. In applications where high heat resistance and/or high humidity resistance is required, the polyurethane dispersion can be mixed with compounds that can react with the polymer to form a crosslinked (thermoset) polymer. These reactive compounds can be mixed with the dispersion before application. Reaction may occur in the polymer film during the drying process of the film or on application of heat to the polymer coating. Crosslinking of the polyurethane leads to better heat, humidity and chemical resistance.

If desired, emulsifiers can be added to the dispersion to further stabilize the dispersion against coagulation due to the addition of external compounds to the dispersion, or against external conditions. The emulsifiers chosen should be those which do not affect the polymer properties or the adhesive properties of the polymer.

BRIEF DESCRIPTION OF THE DRAWING(S)

The drawing is an illustration of a laminated cover stock/face stock.

DESCRIPTION OF THE PREFERRED EMBODIMENT(S)

The drawing shows a cover stock 10 adhered to a face stock 12 with an adhesive 14 of the invention.

The invention will be described with reference to the following non-limiting WA-057 Examples.

In the following examples, adhesives are identified WA-140 and WA-135/WA-057. WA-140 and WA-135/WA-57 are examples of one- and two-part polyurethane adhesives respectively. However, WA-140 can also be used as a two-part adhesive. These adhesives are generally polyester-based polyurethane adhesives. If more heat is available for lamination, WA-140 is preferred. If less heat is available, WA-135 is preferred. Generally, these polyester based polyurethane adhesives have a softening or activation temperature in the range of 40–110° C.

WA-135 contains adipic dihydrazide which allows it to cure better with isocyanate curatives. It can also undergo a cyclization reaction with heat to improve the properties of the adhesive. The elimination of water during cyclization can also keep the cure moving forward with the isocyanate.

WA-140 is a hydrazine extended adhesive which is more like a coating than an adhesive which is why it activates at a much higher temperature. It has good properties without the necessity of a cure. The hydrazine gives the adhesive toughness. This adhesive also can undergo a cyclization reaction to enhance its properties even further.

Good adhesion between the film and the vinyl is important but the adhesives must have good elastic properties. The flex property is a key property. The adhesive must meet or exceed the flex-test as set forth in published ASTM D 2907-95 which standard is incorporated by reference in its entirety into this disclosure. Briefly, in this test, two pistons are spaced apart from one another. One is fixed, the other reciprocates. The longitudinal axis of the pistons are coincident. The laminate is shaped into a sleeve, the ends of the sleeve are fixed to the pistons. The reciprocating piston 'flexes' the sleeve. The laminate is visually observed for delamination, clouding or crazing.

EXAMPLE I

In the following formulations, the components are by weight based on total weight of the formulation.

WA-140

| Components | Parts | Range |
|---|---|---|
| Hexane diol adipate/hexane diol isophthalate (50/50 by weight %) | 0.2781 | ±10% |
| dimethylolpropionic acid | 0.0124 | ±10% |
| Isophorone diisocyanate | 0.0914 | ±10% |
| n-Methyl pyrrolidone | 0.0675 | ±10% |
| Hydrazine | 0.0140 | ±10% |
| $H_2O$ | 0.5260 | ±10% |
| Triethylamine | 0.0101 | ±10% |
| stannous octoate[1] | 0.00002 | 0–5% |
| Benzene propionic acid (3,5-bis-(1,1-dimethyl ethyl)-4-hydroxy-2,2-bis[3,5 bis (1,1-dimethyl ethyl)-4-hydroxy phenol]-1-oxoproxyl 1,3-propanediyl ester[2] | 0.0004 | 0–5% |
| *can vary 75/25 to 25/75 by weight | | |

[1]Cata-check 860, Ferro Mfg.
[2]Bennox 1010, Mayzo

The adhesive WA-140 can be further modified by adding an effective amount, 1–5% by weight, of polyaziridine, polycarbodiimide or polyisocyanate for pre-internal or post cross-linking of the coating.

EXAMPLE II

An adhesive of the invention is a two-part polyurethane, WA-135/WA-057.

WA-135 is a water base polyurethane and WA-057 is a polyfunctional, 100% solids, isocyanate curative.

WA-135

| Components | Parts | Range |
|---|---|---|
| Neopentyl glycol isophthalate/hexane diol adipate/hexane diol isophthalate | 0.0893 | ±10% |
| n-Methyl pyrrolidone | 0.0738 | ±10% |
| Dimethylol propionic acid | 0.0203 | ±10% |
| Butane diol adipate | 0.1592 | ±10% |
| Butadiene diol | 0.5300 | ±10% |
| Isophorone diisocyanate | 0.0692 | ±10% |
| Trimethyl hexamethylene diisocyanate | 0.0271 | ±10% |
| Adipic dihydrazide | 0.0073 | ±10% |
| $H_2O$ | 0.4749 | ±10% |
| Triethylamine | 0.0151 | ±10% |
| Polyurethane associative thickener[1] | 0.0035 | 0–5% |
| Red colorant[2] | 0.0050 | 0–5% |
| Silicone defoamer[3] | 0.0001 | 0–5% |
| Bacteriocide[4] | 0.0050 | 0–5% |
| Modified polysiloxane[5] | 0.0015 | 0–5% |

[1]Acrysol RM-825, Rohm & Haas
[2]WD2673, Daniels
[3]Defo 97-3, Ultra Adhesives
[4]Proxcel GXL 20% Solution, Zeneca
[5]BYK 348, BYK

WA-057

| Components | Parts | Range |
|---|---|---|
| Water dispersible aliphatic polyisocyanate, e.g. hexamethylene diisocyanate | 0.0500 | ±10% |

Weight percent of components based on total weight of the adhesive.

EXAMPLE III

Vinyl face stock, specifically Athol vinyl was formed with an anti-graffiti coating as follows.

A polypropylene film (high-density) 1.2 mils thick was coated with adhesive WA-140 0.12 oz per $ft^2$ and allowed to dry. The polypropylene film/adhesive comprised the anti-graffiti coating stock. The vinyl face stock, 23–24 mils thick, was coated with the same adhesive system 0.12 oz per $ft^2$. Coating weights of 0.8 to 0.16 oz per ft are suitable for purposes of the invention. The surfaces were heated to about 95° C. and pressure nipped with 40 pounds of pressure to form a laminate.

EXAMPLE IV

The vinyl face stock and high density polypropylene film were each coated with the adhesive WA-135/WA-057 0.12 oz per $ft^2$. The surfaces were heated to about 65° C. and then pressure nipped with 40 pounds of pressure to form a laminate.

The following tests were conducted to establish that anti-graffiti coatings, the laminates of Examples III and IV, were suitable for their intended purpose. Testing of the finished laminates consisted of marking the surfaces with various graffiti, such as paint sprays, inks, marking pens and the like, and cleaning them off with solvents. The anti-graffiti nature of the film allowed for the complete removal of all markings restoring the surface to its original appearance.

The laminates underwent flex tests ASTMD 2907-95 and the laminates did not cloud or craze or give any indication of loss of adhesion during flexing.

It should be noted that the adhesive systems are also capable of bonding primed TEDLAR® to vinyl with excellent performance results. Generally, the adhesive only has to be placed on the vinyl since the Tedlar is usually primed. Alternatively, the polyolefin film can be primed and then only the vinyl substrate has to be coated as an alternate approach.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. An anti-graffiti cover stock for vinyl face stocks which comprises:

a film selected from the group consisting of polyolefins and polyvinyl fluoride; and a polyester based polyurethane adhesive coated on one surface of the film to form a cover stock characterized in that when adhered to a vinyl substrate to form a laminate, the laminate meets the flex characteristics of ASTM D 2907-95.

2. The cover stock of claim 1 wherein the film has a thickness of between about 0.8 to 16 mils.

3. The cover stock of claim 2 wherein the film is a polyolefin is selected from the group consisting of polypropylene and high-density polyethylene.

4. The cover stock of claim 1 wherein the adhesive is applied to the polyolefin in a coating weight of between 0.8 to 0.16 oz per $ft^2$.

5. The cover stock of claim 1 wherein the adhesive is a polyurethane dispersion comprising an organic isocyanate compound; an active hydrogen containing organic compound having an ionized or easily ionizable group; a polymeric polyol; at least a first extender and a base wherein the organic isocyanate compound is initially reacted with a sufficient amount of active hydrogen containing organic compound and polyol to form an isocyanate terminated prepolymer, which prepolymer is reactive with extenders for increasing the molecular weight of the prepolymer and the polymer is then treated with the base.

6. The composition of claim 5 wherein the organic isocyanate is selected from the group consisting of 4,4'-diphenylmethane diisocyanate (MDI), 2,4- and 2,6-toluene diisocyanate (TDI), ditolyl diisocyanate (TODI), 1,5-naphthalene diisocyanate, 4,4'-dibenzal diisocyanate, m- or p-xylene diisocyanate, 1,3-phenylene diisocyanate, 1,6-hexamethylene diisocyanate, isophorone diisocyanate and 1,4-cyclohexane diisocyanate.

7. The composition of claim 5 wherein the polyol is selected from the group consisting of a hexane diol mixed acid polyester diol and a caprolactone-based polyester diol.

* * * * *